US007569986B2

(12) United States Patent
Chi et al.

(10) Patent No.: US 7,569,986 B2
(45) Date of Patent: Aug. 4, 2009

(54) ELECTRON EMISSION DISPLAY HAVING ELECTRON BEAMS WITH REDUCED DISTORTION

(75) Inventors: Eung-Joon Chi, Yongin-si (KR); Seung-Joon Yoo, Yongin-si (KR); Cheol-Hyeon Chang, Yongin-si (KR)

(73) Assignee: Samsung SDI Co., Ltd., Suwon-Si (KR)

( * ) Notice: Subject to any disclaimer, the term of this patent is extended or adjusted under 35 U.S.C. 154(b) by 0 days.

(21) Appl. No.: 11/584,129

(22) Filed: Oct. 20, 2006

(65) Prior Publication Data

US 2007/0096626 A1 May 3, 2007

(30) Foreign Application Priority Data

Oct. 31, 2005 (KR) ..... 10-2005-0103526

(51) Int. Cl.
*H01J 1/62* (2006.01)
*H01J 63/04* (2006.01)

(52) U.S. Cl. ..... 313/497; 313/495; 313/496; 313/310; 315/169.3

(58) Field of Classification Search ..... 313/306, 313/309–310, 293–304, 495–497
See application file for complete search history.

(56) References Cited

U.S. PATENT DOCUMENTS 5,786,656 A 7/1998 Hasegawa et al.
5,955,833 A 9/1999 Janning
5,955,850 A 9/1999 Yamaguchi et al.
6,049,165 A * 4/2000 Spindt et al. ..... 313/495
6,084,339 A 7/2000 Xie et al.
6,094,001 A 7/2000 Xie
6,338,662 B1 1/2002 Spindt et al.
6,541,905 B1 * 4/2003 Fushimi et al. ..... 313/495
6,570,322 B1 * 5/2003 Rasmussen ..... 313/496

(Continued)

FOREIGN PATENT DOCUMENTS

EP 1 696 465 A1 8/2006

(Continued)

OTHER PUBLICATIONS

European Search Report dated Apr. 5, 2007, for EP 06122729.4, in the name of Samsung SDI Co., Ltd.

*Primary Examiner*—Sikha Roy
(74) *Attorney, Agent, or Firm*—Christie, Parker & Hale, LLP

(57) ABSTRACT

An electron emission display includes first and second substrates facing each other to form a vacuum envelope, a plurality of driving electrodes formed on the first substrate, a plurality of electron emission regions controlled by the driving electrodes, a focusing electrode disposed on and insulated from the driving electrodes and provided with first openings through which electron beams pass, a plurality of phosphor layers formed on a surface of the second substrate, an anode electrode formed on surfaces of the phosphor layers, and a plurality of spacers for maintaining a gap between the first and second substrates. The focusing electrode includes second openings for forming a potential control unit for forming a potential well, the potential control unit being formed between the first openings to correspond to the spacers. The potential well attracts the electron beams, improving the directionality of the beams.

18 Claims, 5 Drawing Sheets

U.S. PATENT DOCUMENTS

| | | | | |
|---|---|---|---|---|
| 6,756,729 | B1 * | 6/2004 | Na et al. | 313/496 |
| 6,853,126 | B2 | 2/2005 | Nomura | |
| 2004/0130258 | A1 * | 7/2004 | Oh | 313/495 |
| 2004/0135493 | A1 * | 7/2004 | Park et al. | 313/497 |
| 2004/0145298 | A1 * | 7/2004 | Seon et al. | 313/495 |
| 2004/0169459 | A1 | 9/2004 | Nakamura et al. | |
| 2005/0139817 | A1 | 6/2005 | Choi et al. | |
| 2005/0184647 | A1 * | 8/2005 | Chang | 313/497 |
| 2005/0189865 | A1 | 9/2005 | Lee | |
| 2005/0242705 | A1 * | 11/2005 | Kim | 313/495 |
| 2005/0264165 | A1 * | 12/2005 | Ryu | 313/495 |
| 2005/0280350 | A1 * | 12/2005 | Seon | 313/496 |
| 2007/0090746 | A1 | 4/2007 | Hwang | |

FOREIGN PATENT DOCUMENTS

| | | | |
|---|---|---|---|
| EP | 1 708 237 | A1 | 10/2006 |
| JP | 11-111157 | A | 4/1999 |
| WO | WO 00/24027 | | 4/2000 |
| WO | WO 02/065499 | A2 | 8/2002 |

* cited by examiner

ELECTRON EMISSION DISPLAY HAVING ELECTRON BEAMS WITH REDUCED DISTORTION

CROSSED-REFERENCE TO RELATED APPLICATION

This application claims priority to and the benefit of Korean Patent Application No. 10-2005-0103526, filed on Oct. 31, 2005, in the Korean Intellectual Property Office, the entire content of which is incorporated herein by reference.

BACKGROUND OF THE INVENTION

1. Field of the Invention

The present invention relates to an electron emission display, and more particularly, to an electron emission display that can effectively focus electron beams emitted from electron emission regions by improving a focusing electrode.

2. Description of Related Art

In general, an electron emission element can be classified, depending upon the kind of electron source, into a hot cathode type or a cold cathode type.

There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

An FEA element includes electron emission regions and cathode and gate electrodes that are used as the driving electrodes. The electron emission regions are formed of a material having a relatively low work function and/or a relatively large aspect ratio, such as a molybdenum-based (Mo) material, a silicon-based (Si) material, and a carbon-based material such as carbon nanotubes (CNT), graphite, and diamond-like carbon (DLC) so that electrons can be effectively emitted when an electric field is applied to the electron emission regions under a vacuum atmosphere (or vacuum state). When the electron emission regions are formed of the molybdenum-base material or the silicon-based material, they are formed as a pointed tip structure.

The electron emission elements are arrayed on a first substrate to form an electron emission device. A light emission unit (having phosphor layers and an anode electrode) is formed on a second substrate. The first and second substrates, the electron emission device, and the light emission unit establish an electron emission display.

The electron emission device includes electron emission regions and a plurality of driving electrodes functioning as scanning and data electrodes. The electron emission regions and the driving electrodes control the on/off operation of each pixel and the amount of electrons emitted. The electrons emitted from the electron emission regions excite the phosphor layers to display an image (which may be predetermined).

The first and second substrates are sealed together at their peripheries using a sealing member, and the inner space between the first and second substrates is exhausted to form a vacuum envelope. In addition, a plurality of spacers are disposed in the vacuum envelope between the first and second substrates to prevent the substrates from being damaged or broken by a pressure difference between the inside and outside of the vacuum envelope.

The spacers are exposed to the internal space of the vacuum envelope in which electrons emitted from the electron emission regions move. The spacers are positively or negatively charged by the electrons colliding therewith. The charged spacers may distort the electron beam path by attracting or repulsing the electrons. As a result, a non-emission region of the phosphor layer increases.

For example, when the spacers are positively charged, the spacers attract the electrons such that a relatively large amount of electrons collides with a portion of the phosphor layer near the spacers. As a result, the luminance of the portion of the phosphor layer around the spacers is higher than the luminance of other portions. In this case, the spacers may be detected (observed) on a screen.

In order to reduce or prevent the distortion of the electron beam path, the spacers may be coated with an insulation material or may be connected to the electrodes to discharge the electric charges accumulated on the spacers.

However, due to defective connections between the spacers and the electrodes, the discharge of the electric charges is not effectively realized.

SUMMARY OF THE INVENTION

An aspect of the present invention provides an electron emission display that can compensate for the distortion (or scan distortion) of electron beams, which is caused by the positive or negative charge accumulated on the spacers, by varying an equipotential line around the electron beams.

According to an exemplary embodiment of the present invention, there is provided an electron emission display including: first and second substrates facing each other to form a vacuum envelope; a plurality of driving electrodes formed on the first substrate; a plurality of electron emission regions controlled by the driving electrodes; a focusing electrode disposed on and insulated from the driving electrodes and provided with first openings through which electron beams pass; a plurality of phosphor layers formed on a surface of the second substrate; an anode electrode formed on surfaces of the phosphor layers; and a plurality of spacers for maintaining a gap between the first and second substrates, wherein the focusing electrode comprises a potential control unit for forming a potential well, the potential control unit being formed between the first openings and corresponding to the spacers.

The potential control unit may be formed by removing a portion of the focusing electrode.

The potential control unit may include second openings formed on the focusing electrode to expose an insulation layer formed under the focusing electrode.

The focusing electrode may be formed in a single layer with the spacers disposed on the focusing electrode.

The spacers may be wall-type spacers.

The potential control unit may be formed in a single section corresponding to a length of the spacer, or, alternatively, the potential control unit may be divided into at least two sections corresponding to a length of each spacer.

Each section of the potential control unit may correspond to each first opening of the focusing electrode.

The spacer may be formed in a cylindrical shape.

The potential control unit may be formed in a rectangular shape.

The driving electrodes may include a plurality of cathode electrodes on which the insulation layer is formed and a plurality of gate electrodes formed on the cathode electrodes and crossing the cathode electrodes. The electron emission regions are formed on the cathode electrodes at each crossed area of the cathode and gate electrodes.

The first openings in the focusing electrode may correspond on a one to one basis with each crossed area of the cathode and gate electrodes.

The electron emission regions may be formed of a material selected from the group consisting of carbon nanotubes, graphite, graphite nanofibers, diamonds, diamond-like carbon, $C_{60}$, silicon nanowires, and combinations thereof.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the invention may be embodied in many different forms and should not be construed as being limited to the embodiments set forth herein.

Figure 1:
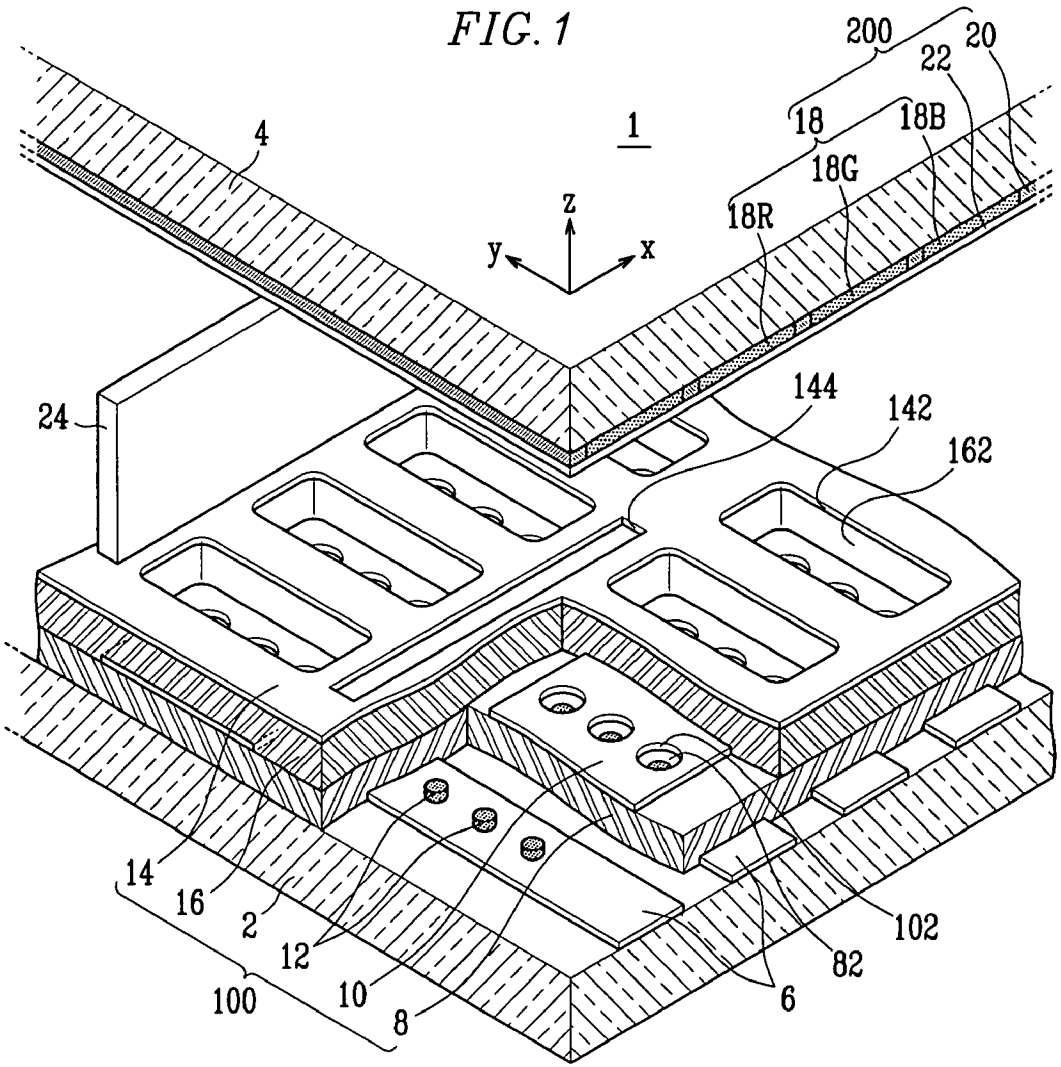
FIG. 1 is a partial exploded perspective view of an electron emission display according an embodiment of the present invention.
Figure 2:
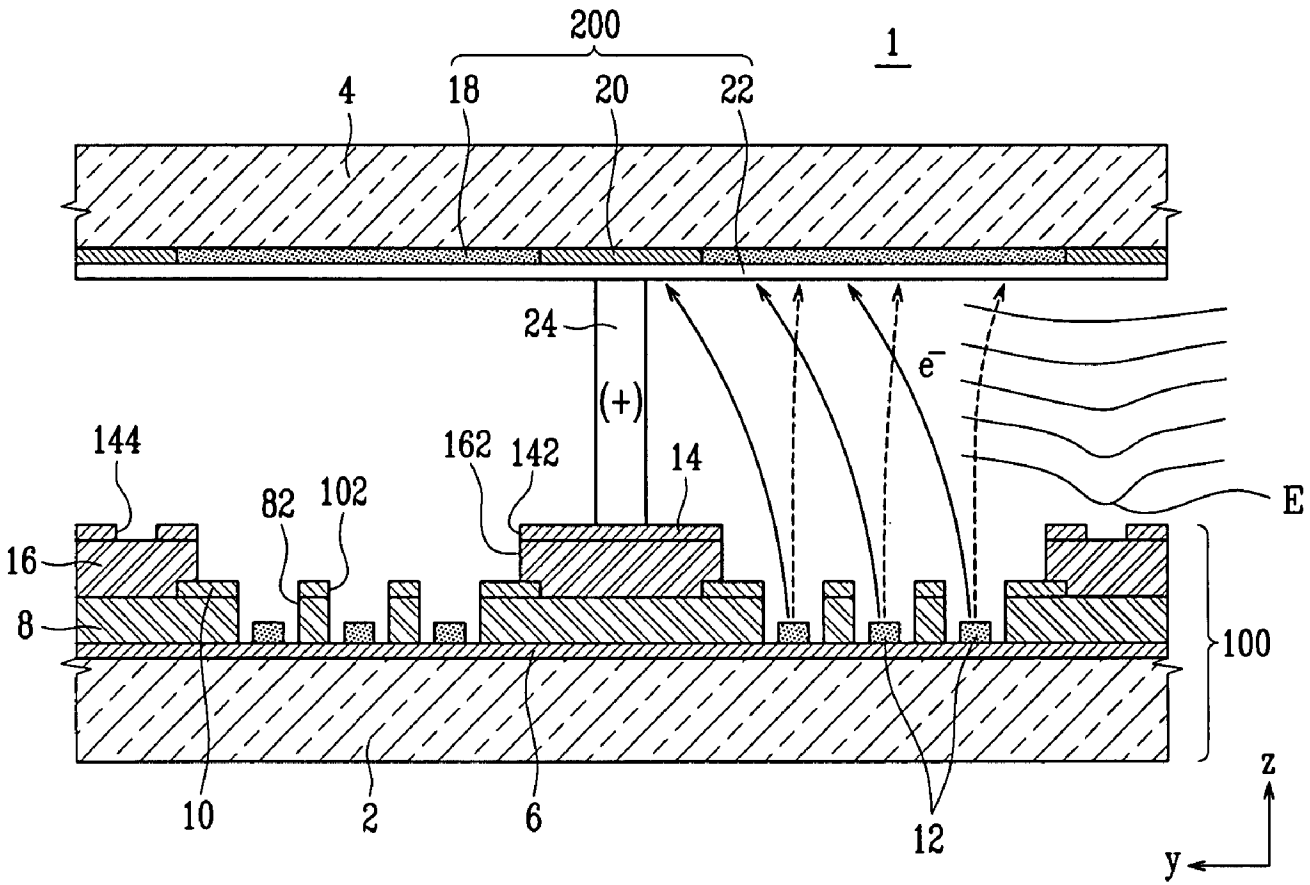
FIG. 2 is a partial sectional view of the electron emission display of FIG. 1.
Figure 3:
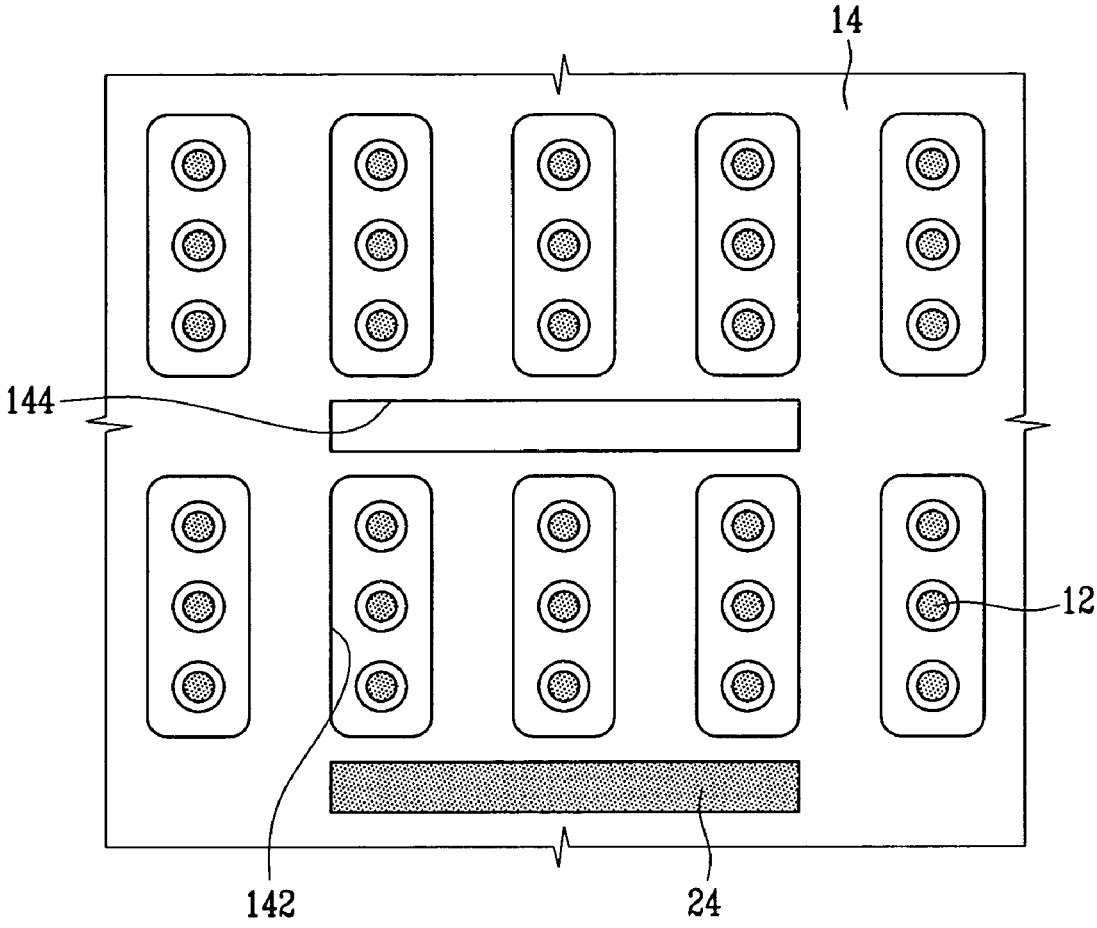
FIG. 3 is a partial top view of the electron emission display of FIG. 1.

FIGS. 1 through 3 show an electron emission display 1 according to an embodiment of the present invention.

Referring to FIGS. 1 and 2, the electron emission display 1 includes first and second substrates 2 and 4 facing each other and spaced apart by a distance (which may be predetermined). A sealing member (not shown) is provided at the peripheries of the first and second substrates 2 and 4 to seal them together. The space defined by the first and second substrates 2 and 4 and the sealing member is exhausted to form a vacuum envelope (or chamber) kept to a degree of vacuum of about $10^{-6}$ Torr.

A plurality of electron emission elements are arrayed on the first substrate 2 to form an electron emission device 100. The electron emission display 1 is composed of the electron emission device 100 and the second substrate 4 on which a light emission unit 200 is formed.

A plurality of cathode electrodes (first driving electrodes) 6 are arranged on the first substrate 2 in a stripe pattern extending along a direction (a direction of a y-axis in FIG. 1) and a first insulation layer 8 is formed on the first substrate 2 to cover the cathode electrodes 6. A plurality of gate electrodes (second driving electrodes) 10 are formed on the first insulation layer 8 in a stripe pattern extending along a direction (a direction of an x-axis in FIG. 1) to cross the cathode electrodes 6 at right angles.

Each crossed area of the cathode and gate electrodes 6 and 10 defines a unit pixel. One or more electron emission regions 12 are formed on the cathode electrode 6 at each unit pixel. Openings 82 and 102 corresponding to the electron emission regions 12 are formed on the first insulation layer 8 and the gate electrodes 10 to expose the electron emission regions 12.

The electron emission regions 12 may be formed of a material which emits electrons when an electric field is applied thereto under a vacuum atmosphere, such as a carbonaceous material and/or a nanometer-sized material. For example, the electron emission regions 12 may be formed of carbon nanotubes (CNT), graphite, graphite nanofibers, diamonds, diamond-like carbon (DLC), $C_{60}$, silicon nanowires, or combinations thereof.

Alternatively, the electron emission regions 12 may be formed as a Molybdenum-based and/or Silicon-based pointed-tip structure.

The electron emission regions 12 may be formed in series along a length of one of the cathode and gate electrodes 6 and 10. Each of the electron emission regions 12 may have a flat, circular top surface. The arrangement and shape of the electron emission regions 12 are, however, not limited to the above description.

In the foregoing description, an embodiment where the gate electrodes 10 are placed above the cathode electrodes 6 with the first insulation layer 8 interposed therebetween is described, but the present invention is not limited to this embodiment. That is, the gate electrodes may be disposed under the cathode electrodes with the first insulation layer interposed therebetween. In this case, the electron emission regions may be formed on sidewalls of the cathode electrodes on the first insulation layer.

A second insulation layer 16 is formed on the first insulation layer 8 while covering the gate electrodes 10, and a focusing electrode 14 is formed on the second insulation layer 16. The gate electrodes 10 are insulated from the focusing electrode 14 by the second insulation layer 16. Openings 142 and 162 through which electron beams pass are formed through the second insulation layer 16 and the focusing electrode 14.

Each of the openings 142 of the focusing electrode 14 may be formed for each unit pixel to focus the electrons emitted for each unit pixel. Alternatively, each of the openings 142 of the focusing electrodes 14 may be formed for each opening 102 of the gate electrode 10 to individually focus the electrons emitted from each electron emission region 12. The former is shown in this embodiment.

In addition, the focusing electrode 14 may be formed on an entire surface of the second insulation layer 16 or may be formed in a certain (or predetermined) pattern having a plurality of sections.

Describing the light emission unit 200, phosphor layers 18 such as red, green and blue phosphor layers 18R, 18G and 18B are formed on a surface of the second substrate 4 facing the first substrate 2. Black layers 20 for enhancing the contrast of the screen are arranged between the red, green and blue phosphor layers 18R, 18G and 18B. The phosphor layers 18 may be formed to correspond to the unit pixels defined on the first substrate 2.

An anode electrode 22 formed of a conductive material, such as aluminum, is formed on the phosphor and black layers 18 and 20. The anode electrode 22 functions to heighten the screen luminance by receiving a high voltage required to accelerate the electron beams, and by reflecting the visible rays radiated from the phosphor layers 18 to the first substrate 2 back toward the second substrate 4.

Alternatively, the anode electrode 22 can be formed of a transparent conductive material, such as Indium Tin Oxide (ITO), instead of a metallic material. In this case, the anode electrode 22 is formed on the second substrate 4, and the phosphor and black layers 18 and 20 are formed on the anode electrode 22. Alternatively, the anode electrode 22 may include a transparent conductive layer and a metallic layer.

Disposed between the first and second substrates 2 and 4 are spacers 24 for uniformly maintaining a gap between the first and second substrates 2 and 4. The spacers 24 are arranged corresponding to the black layer 20 so that the spacers 24 do not obstruct the phosphor layers 18. In FIG. 1, a wall-type spacer is shown.

According to this embodiment, in order to provide directionality to the electron beam, the focusing electrode 14 includes a potential control unit for forming a potential well. As shown in FIG. 1, the potential control unit is formed by eliminating a portion of the focusing electrode 14. The potential control unit includes an opening 144 formed through the focusing electrode 14 to expose the second insulation layer 16. Hereinafter, for descriptive convenience, the openings for allowing the electron beams to pass will be referred to as first openings and the opening for the potential control unit are referred to as second openings.

As shown in FIG. 2, the second opening 144 forms a potential well E, which is concave with respect to the second substrate 4 so that an equipotential line formed along the surface of the focusing electrode 14 can have a potential lower than the surrounding potential. The potential well E attracts the electron beam traveling toward the second substrate 4. Therefore, the electron beams that would be deflected toward the spacer 24 are attracted by the potential well E, as a result of which the directionality of the electron beams can be improved.

The second opening 144 may be formed between the first openings 142 to correspond to the spacer 24. In this case, a distortion of the electron beam path (a state where the electron beam path is curved in a direction indicated by solid arrow of FIG. 2), caused by the spacer 24 that is positively charged by the secondary electron emission, can be reduced or prevented. That is, the potential well E is formed around the first opening 142 at a location facing the spacer 24 so that the electron beam attractive force of the spacer 24 can be balanced with the electron beam attractive force of the potential well E, thereby maintaining the directionality of the electron beam (indicated by the dotted arrow of FIG. 2).

Referring to FIG. 3, the second opening 144 may be formed in a rectangular single section so that the potential well is formed along (or correspond to) the length of the wall-type spacer 24.

Figure 4:
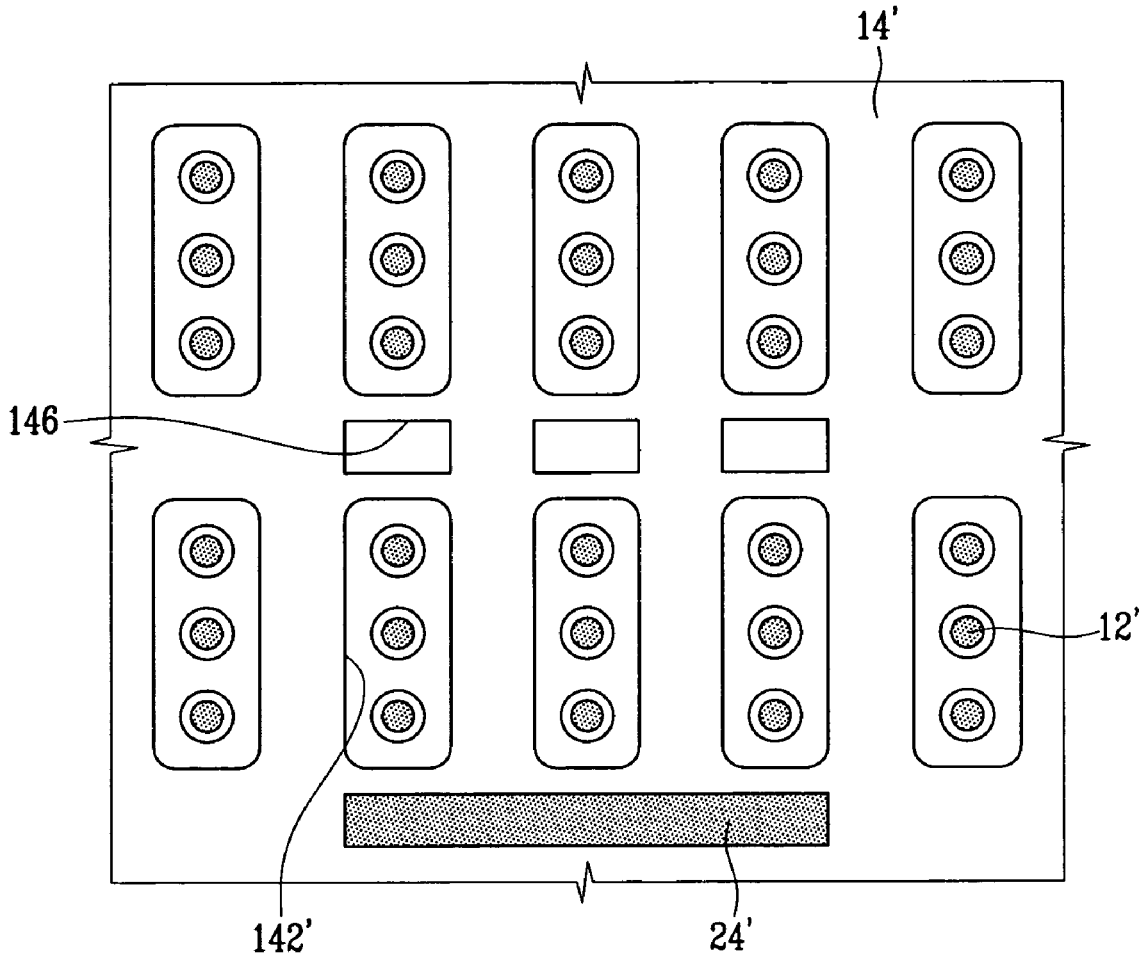
FIG. 4 is a partial top view of an electron emission display according to another embodiment of the present invention.

FIG. 4 shows an electron emission display according to another embodiment of the present invention.

Referring to FIG. 4, second openings (or sections) 146 are formed on a focusing electrode 14', which corresponds to one spacer 24'. Each of the second openings (or sections) 146 corresponds to at least one of the first opening 142'.

Figure 5:
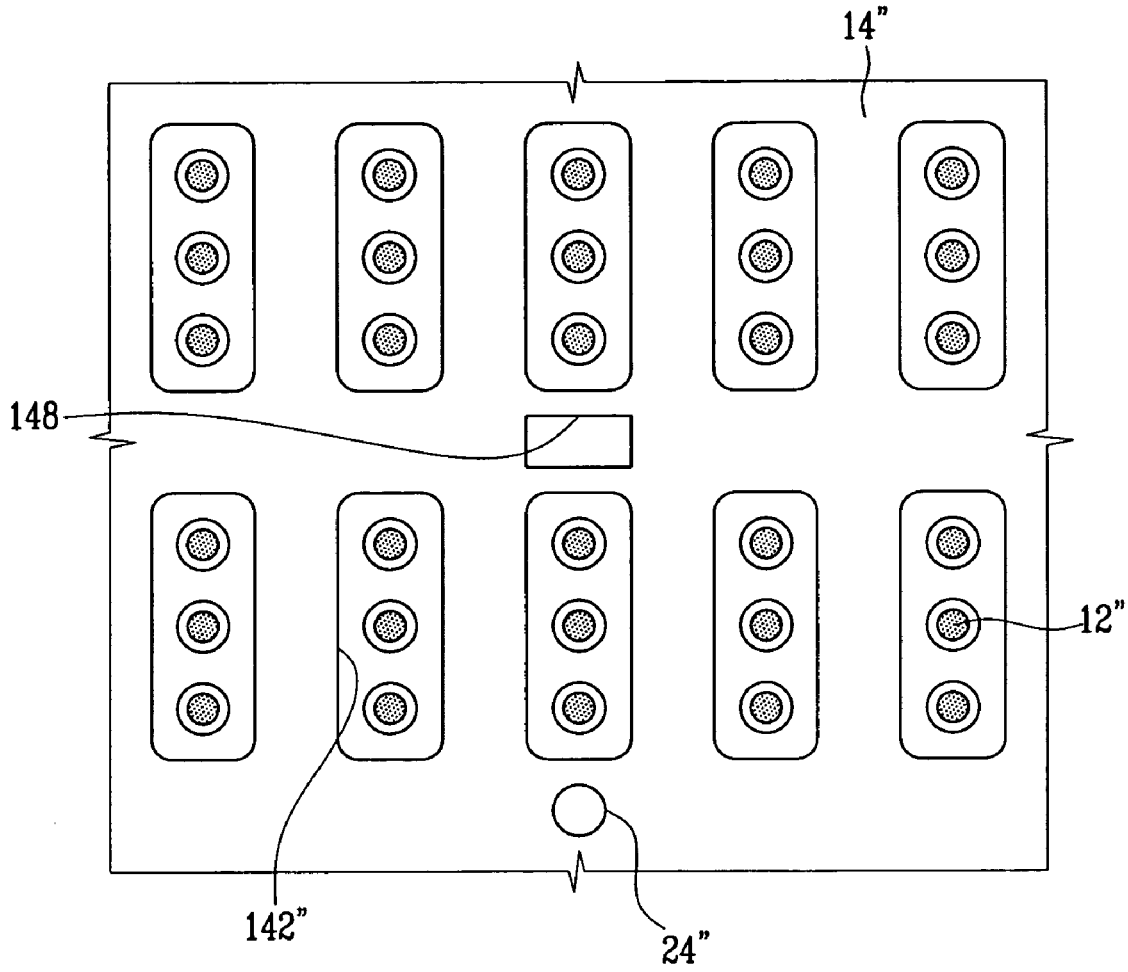
FIG. 5 is a partial top view of an electron emission display according to another embodiment of the present invention.

FIG. 5 shows an electron emission display according to another embodiment of the present invention.

FIG. 5 shows a spacer 24" formed in a cylindrical shape. A second opening 148 corresponding to the cylindrical spacer 24" is formed on a focusing electrode 14" between two of the first openings 142".

In FIGS. 4 and 5, the reference numerals 12' and 12" denote the electron emission regions.

As described above, the arrangement, shape, position, and size of the second opening can be varied according to the shape of the spacer, the types of electric charge, the degree of the electron beam distortion, and other suitable factors.

The above-described electron emission display is driven when a certain (or predetermined) voltage is applied to the cathode, gate, focusing, and anode electrodes 6, 10, 14, and 22.

For example, the cathode electrodes 6 may serve as scanning electrodes receiving a scan drive voltage, and the gate electrodes 10 may function as data electrodes receiving a data drive voltage, or vice versa. The focusing electrode 14 receives a voltage for focusing the electron beams, for example, 0V or a negative direct current voltage ranging from several to several tens of volts. The anode electrode 22 receives a voltage for accelerating the electron beams, for example, a positive direct current voltage ranging from hundreds through thousands of volts.

Electric fields are formed around the electron emission regions 12 at unit pixels where a voltage difference between the cathode and gate electrodes 6 and 10 is equal to or higher than a threshold value and thus the electrons are emitted from the electron emission regions 12. The emitted electrons are attracted to the corresponding phosphor layers 18 by the high voltage applied to the anode electrode 22, and strike the phosphor layers 18, thereby exciting the phosphor layers 18 to emit light.

During the above-described driving operation, the spacer 24 may be positively charged to attract the electron beam passing through the first opening 142, 142', 142". But because the potential well E is formed by the second opening 144, 146, 148 at the opposite side of the first opening 142, 142', 142" to attract the electron beam, the attractive force formed by the potential well compensates for the attractive force of the spacer. As a result, the electron beams can maintain their desired paths without being deflected.

Although the electron emission display in the above embodiments is described as having the FEA type of electron emission elements, the present invention is not limited to this example. That is, the present invention may be applied to an electron emission display having other types of electron emission elements such as SCE elements, MIM elements and MIS elements.

According to the present invention, by providing the potential control unit forming the potential well on the focusing electrode, the electron beam distortion phenomenon caused by the spacer can be reduced or prevented. Therefore, the non-emission area of the phosphor layer can be reduced, thereby realizing a high quality image.

While the invention has been described in connection with certain exemplary embodiments, it will be appreciated by those skilled in the art that the invention is not limited to the disclosed embodiments, but, on the contrary, is intended to cover various modifications included within the principles and spirit of the invention, the scope of which is defined in the claims and their equivalents.

What is claimed is:

1. An electron emission display comprising:

a first substrate;

a second substrate facing the first substrate to form a vacuum envelope;

a plurality of driving electrodes formed on the first substrate;

a plurality of electron emission regions controlled by the driving electrodes;

a focusing electrode disposed on and insulated from the driving electrodes and provided with a plurality of first openings through which electron beams pass;

a plurality of phosphor layers formed on a surface of the second substrate;

an anode electrode formed on surfaces of the phosphor layers; and a plurality of spacers for maintaining a gap between the first and second substrates, wherein the focusing electrode comprises a potential control unit for forming a potential well to compensate for distortion of the electron beams caused when electric charges are accumulated on the spacers, the potential control unit being formed by removing a portion of the focusing electrode to expose a top surface of an underlying insulation layer contacting the focusing electrode, and positioned between at least two of the first openings to correspond to the spacers such that the potential control unit is configured to form an electric field for countering an effect on the electron beams of an electric field from the electric charges accumulated on the spacers.

2. An electron emission display comprising:

a first substrate;

a second substrate facing the first substrate to form a vacuum envelope;

a plurality of driving electrodes formed on the first substrate;

a plurality of electron emission regions controlled by the driving electrodes;

a focusing electrode disposed on and insulated from the driving electrodes and provided with a plurality of first openings through which electron beams pass;

a plurality of phosphor layers formed on a surface of the second substrate;

an anode electrode formed on surfaces of the phosphor layers; and a plurality of spacers for maintaining a gap between the first and second substrates, wherein the focusing electrode comprises a potential control unit for forming a potential well to compensate for distortion of the electron beams caused when electric charges are accumulated on the spacers, the potential control unit being formed by removing a portion of the focusing electrode to expose an underlying insulation layer, and positioned between at least two of the first openings to correspond to the spacers such that the potential control unit is configured to form an electric field for countering an effect on the electron beams of an electric field from the electric charges accumulated on the spacers, and wherein the underlying insulation layer is formed under the focusing electrode for insulating the focusing electrode from the driving electrodes, wherein the potential control unit includes a plurality of second openings formed on the focusing electrode to expose the underlying insulation layer.

3. The electron emission display of claim 2, wherein the focusing electrode is formed as a single body and the spacers are disposed on the focusing electrode.

4. The electron emission display of claim 2, wherein the spacers are wall-type spacers.

5. The electron emission display of claim 2, wherein the spacers have a cylindrical shape.

6. The electron emission display of claim 2, wherein the potential control unit is formed in a rectangular shape.

7. The electron emission display of claim 2, wherein the driving electrodes include a plurality of cathode electrodes on which the insulation layer is formed and a plurality of gate electrodes formed on the cathode electrodes and crossing the cathode electrodes, and wherein the electron emission regions are formed on the cathode electrodes at respective crossed areas of the cathode and gate electrodes.

8. The electron emission display of claim 7, wherein each of the first openings are formed for each of the crossed areas of the cathode and gate electrodes.

9. The electron emission display of claim 7, wherein the electron emission regions are formed of a material selected from the group consisting of carbon nanotubes, graphite, graphite nanofibers, diamonds, diamond-like carbon, $C_{60}$, silicon nanowires, and combinations thereof.

10. The electron emission display of claim 2, wherein the potential control unit is formed as a single second opening corresponding to a length of a corresponding one of the spacers.

11. The electron emission display of claim 2, wherein the potential control unit is formed with at least two sections along a length of a corresponding one of the spacers.

12. The electron emission display of claim 11, wherein each of the second openings of the potential control unit corresponds to each of the first openings.

13. An electron emission display comprising:

a first substrate;

a second substrate facing the first substrate;

a driving electrode formed on the first substrate;

an electron emission region electrically connected to the driving electrode;

an insulation layer formed on the driving electrode;

a focusing electrode contacting the insulation layer and provided with a first opening through which an electron beam passes; and a spacer for maintaining a gap between the first and second substrates, wherein the focusing electrode comprises a potential control unit for forming a potential well to compensate for distortion of the electron beam caused when electric charges are accumulated on the spacer, the potential control unit being formed by removing a portion of the focusing electrode to expose a top surface of the insulation layer, and configured to form an electric field for countering an effect on the electron beam of an electric field from the electric charges accumulated on the spacer.

14. The electron emission display of claim 13, wherein the potential control unit is formed as a single second opening corresponding to a length of the spacer.

15. The electron emission display of claim 13, wherein the potential control unit is formed with at least two sections along a length of a corresponding spacer.

16. An electron emission display comprising:

a first substrate;

a second substrate facing the first substrate;

a driving electrode formed on the first substrate;

an electron emission region electrically connected to the driving electrode;

an insulation layer formed on the driving electrode;

a focusing electrode disposed on the insulation layer and provided with a first opening through which an electron beam passes; and a spacer for maintaining a gap between the first and second substrates, wherein the focusing electrode comprises a potential control unit for forming a potential well to compensate for distortion of the electron beam caused when electric charges are accumulated on the spacer, the potential control unit being formed by removing a portion of the focusing electrode and configured to form an electric field for countering an effect on the electron beam of an electric field from the electric charges accumulated on the spacer; and wherein the potential control unit includes a plurality of second openings formed on the focusing electrode to expose the insulation layer.

17. The electron emission display of claim 16, wherein the driving electrode includes a cathode electrode on which the insulation layer is formed and a gate electrode formed on the cathode electrode and crossing the cathode electrode, and wherein the electron emission region is formed on the cathode electrode at the crossing area of the cathode and gate electrodes.

18. An electron emission display comprising:

a first substrate;

a second substrate facing the first substrate;

a driving electrode formed on the first substrate;

an electron emission region controlled by the driving electrode;

a focusing electrode insulated from the driving electrode and provided with a plurality of first openings through which electron beams pass;

a phosphor layer formed on a surface of the second substrate;

an anode electrode formed on a surface of the phosphor layer; and a spacer for maintaining a gap between the first and second substrates, wherein the focusing electrode comprises a potential control unit for forming a potential well to compensate for distortion of the electron beams caused when electric charges are accumulated on the spacer, the potential control unit being formed by removing a portion of the focusing electrode to expose a top surface of an underlying insulating layer contacting the focusing electrode and positioned between at least two of the first openings and corresponding to the spacer such that the potential control unit is configured to form an electric field for countering an effect on the electron beams of an electric field from the electric charges accumulated on the spacer.

* * * * *